United States Patent [19]

Solheim et al.

[11] Patent Number: 4,667,716

[45] Date of Patent: May 26, 1987

[54] GOLF CLUB HEAD COVER WITH DETACHABLE IDENTIFICATION TAG AND METHOD OF MAKING A GOLF CLUB HEAD COVER

[76] Inventors: John A. Solheim, 529 W. Wakonda La.; Karsten Solheim, 501 W. Wakonda La., both of Phoenix, Ariz. 85023

[21] Appl. No.: 821,418

[22] Filed: Jan. 22, 1986

[51] Int. Cl.[4] ..... A63B 57/00; D05B 1/00

[52] U.S. Cl. ..... 150/52 G; 206/315.4; 112/262.1; 40/915

[58] Field of Search ..... 150/52 G; 206/315.4; 112/262.1, 262.2, 267.1; 40/20 A, 22, 915

[56] References Cited

U.S. PATENT DOCUMENTS

| | | | |
|---|---|---|---|
| 313,362 | 3/1885 | O'Hara | 40/22 X |
| 2,526,985 | 10/1950 | Whitehead | 150/52 G |
| 2,532,195 | 11/1950 | Rosenow et al. | 150/52 G |
| 2,758,559 | 8/1956 | Jonsson | 112/262.1 |
| 2,779,374 | 1/1957 | Clark | 150/52 G |
| 3,023,795 | 3/1962 | Denkert | 150/52 G |
| 3,051,210 | 8/1962 | Mesinger | 150/52 G |
| 3,109,474 | 11/1963 | Levi | 112/262.2 X |
| 3,133,577 | 5/1964 | Bellevue, Sr. | 150/52 G |
| 3,145,749 | 8/1964 | Rosenow | 150/52 G |
| 3,294,138 | 12/1966 | Pawly | 150/52 G |
| 3,295,236 | 1/1967 | Wishnia | 150/52 G X |
| 3,303,865 | 2/1967 | Ouimet | 150/52 G |
| 3,406,419 | 10/1968 | Young | 150/52 G X |
| 3,727,659 | 4/1973 | Shuford | 150/52 G |
| 4,520,855 | 6/1985 | Dien | 150/52 G |

FOREIGN PATENT DOCUMENTS

| | | | |
|---|---|---|---|
| 510020 | 7/1939 | United Kingdom | 150/52 G |

*Primary Examiner*—William Price
*Assistant Examiner*—Sue A. Weaver
*Attorney, Agent, or Firm*—Herbert E. Haynes, Jr.

[57] ABSTRACT

A golf club head cover is made in accordance with a method having a minimal number of steps from a single sheet of fabric-like material which provides both an outer covering and a liner and inherently forms the head cover which closely fits the head of a wood type golf club and has an especially configured constricted bore in the head cover. The head cover is also provided with a detachably mounted golf identification tag which simplifies manufacturing and supply inventories.

27 Claims, 10 Drawing Figures

FIG. 1
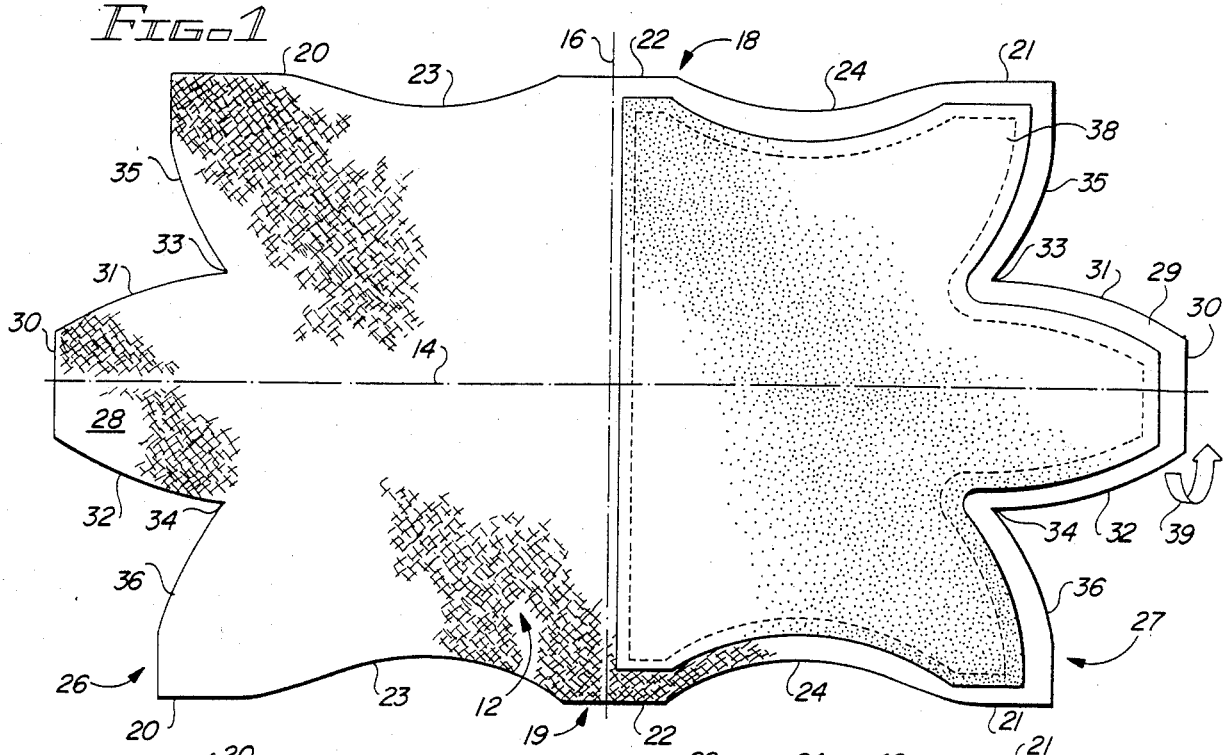
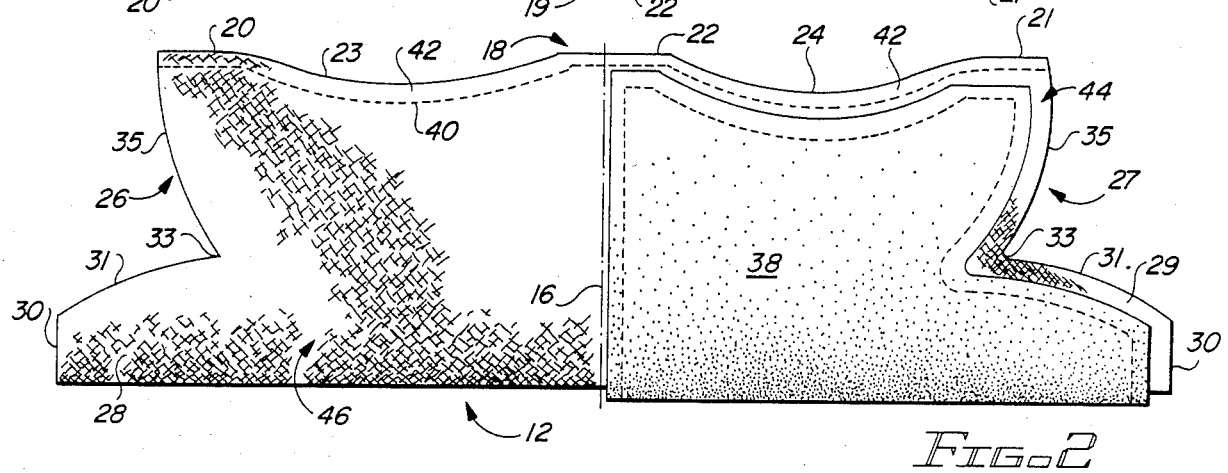
FIG. 2
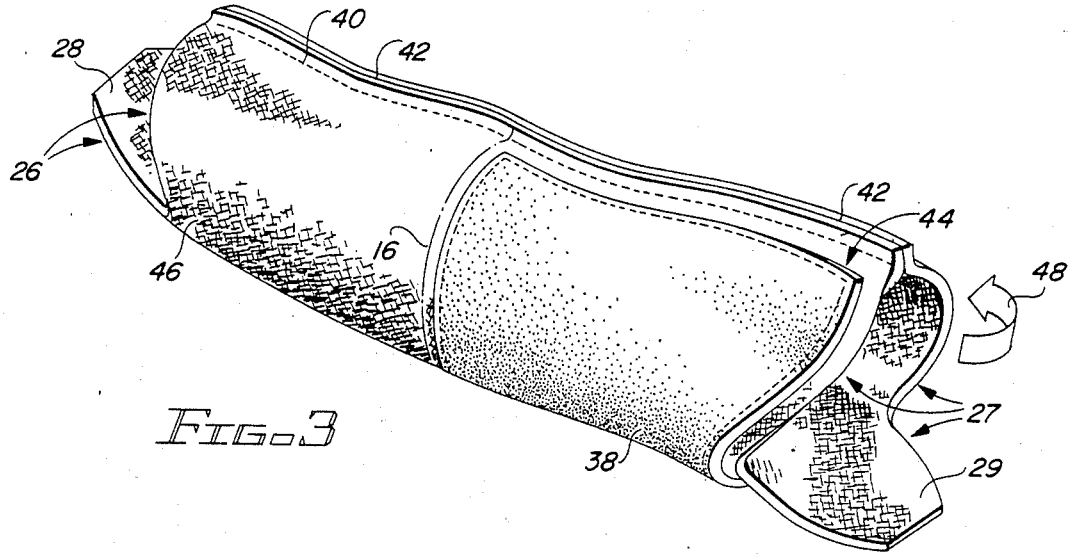
FIG. 3

FIG. 7
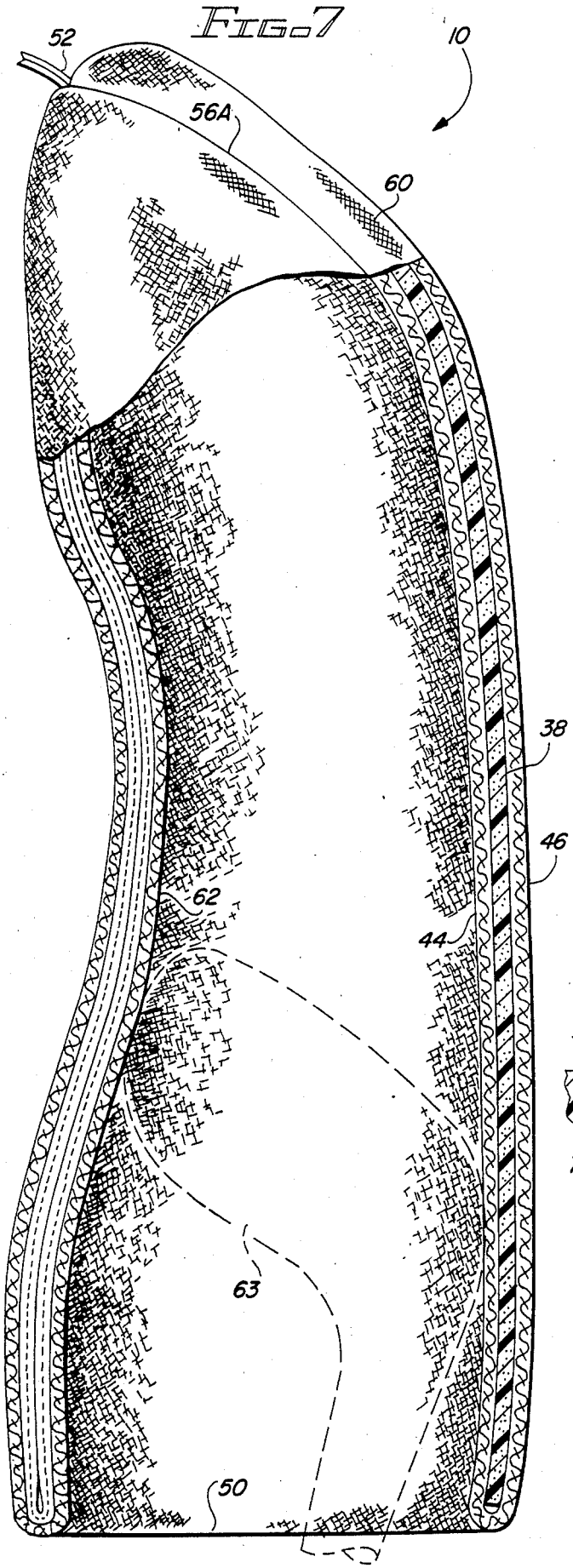
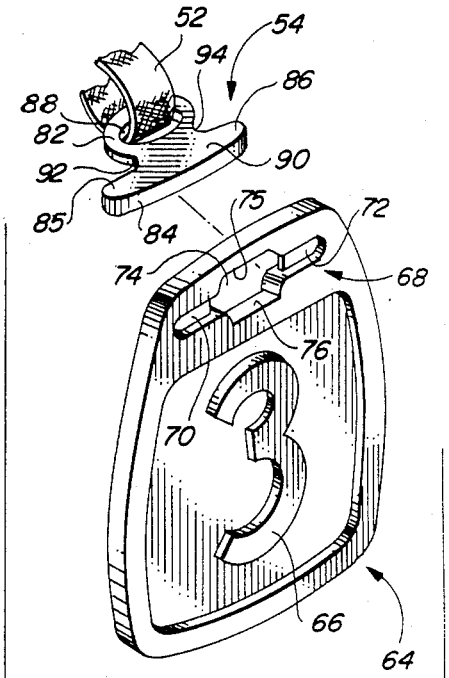
FIG. 8
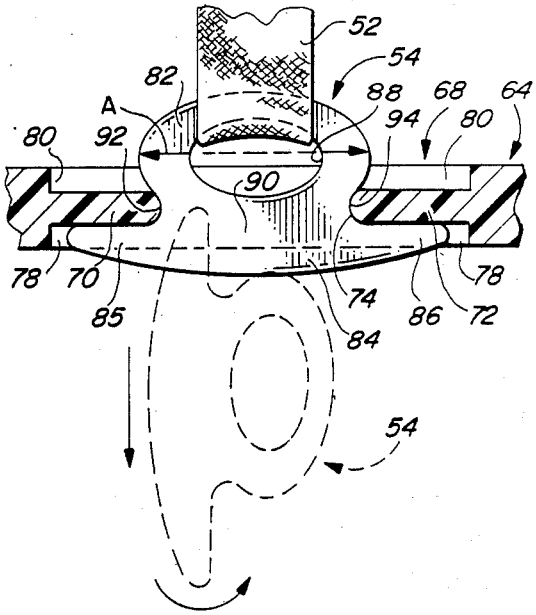
FIG. 9

GOLF CLUB HEAD COVER WITH DETACHABLE IDENTIFICATION TAG AND METHOD OF MAKING A GOLF CLUB HEAD COVER

BACKGROUND OF THE INVENTION

1. Field of the Invention

This invention relates in general to golf equipment and more particularly to an improved golf club head cover having a detachable golf club identification tag.

2. Description of the Prior Art

It is a common practice to use head covers on golf clubs, particularly those referred to as "woods" to protect the golf club heads from damage when not in use. Such head covers are usually fabricated of a fabric-like material and are of a generally tubular configuration with one end being open and the other closed.

In that the heads of golf clubs extend angularly from their shafts the bores of the head covers must be sized to receive the heads but also must be of irregular configuration so as to prevent the head covers from unintentionally falling off of the clubs. To accomplish this, head covers are usually formed with some sort of constriction intermediate their opposite ends so that the golf club heads will freely pass through the open end of the head covers, will be relatively loosely contained in the closed ends, but must be forcefully moved through the constricted areas thereof. Some prior art head covers are formed so that their closed ends are disposed at an angle relative to their open ends to provide the desired constriction at the angular junction thereof. Another prior art head cover is formed with a circumscribing elastic band at the desired point of constriction and still another reduces the dimension of the bore by stitching.

For aesthetic reasons, most head covers are formed by stitching the various pieces together in an inside-out position so that the stitched seams will face inwardly when turned rightside-out upon completion of the sewing operation. However, the internally facing stitched seams should be covered with a suitable liner, at least in the constricted area, so as to minimize the force required to pass the golf club head through the constricted area and to prevent scratching of the finish on the golf club head. In addition to covering the stitched seams, head cover liners are employed in many prior art head covers to provide a double layer of material to protect the golf club head from external blows. And, in some instances a third material layer, such as foam rubber, or the like, is interposed between the outer material and the liner to provide additional cushioning.

Therefore, the fabrication of a well made prior art golf club head cover is a time consuming and relatively costly multistep operation with includes cutting of multiple fabric pieces into the various shapes needed to provide the outer material layer, the liner, and in some instances the interposed cushioning layer, and stitching along a multiplicity of seams to attach the pieces together in the desired head cover configuration.

As is well known, all golf clubs are identified by a number, or letter in some cases, and the identifying indicia is marked on the head of the golf club. Gold clubs of the type referred to as "woods" are commonly identified by numbers ranging from one (1) up as high as seven (7) and in some instances higher and these numbers are located on the sole of the woods. Therefore, when head covers are placed on the heads of the woods, the club identifying indicia is hidden. Further, most golfers will carry at least three different types of woods in their golf bags. For these reasons, head covers are provided with means for identifying the particular golf clubs upon which they are placed.

The prior art golf club head covers accomplish club identification in various ways. Some identify the club by embroidering the desired number on the cover at the closed upper end thereof. This is not a widely used technique however due to the time involved in direct embroidery.

Another technique which is not widely used, for the same reasons, in embroidering or otherwise providing the indicia on a patch and sewing the patch on the head cover at the time of fabrication thereof.

The most commonly used technique for providing identifying indicia on a head cover is to provide the indicia on a rigid tag, and hang that tag on the head cover at the closed upper end thereof. The tag is formed with a slot and a fabric strap is passed through the slot and folded back onto itself to provide a loop. The free ends of the looped over strap are captively attached in a seam of the head cover by being sewn therein simultaneously with the stitched closing of that seam.

One problem associated with such methods of providing club identifying indicia on head covers is that the indicia becomes an integral part of the head cover at the time of manufacture and thus, cannot be changed to suit the particular club selection being carried by an individual golfer.

In order for a golfer to select a head cover set for the particular combination of woods he or she desires to use, the manufacturer must make and the supplier must carry a complete selection of head covers. This causes inventory and supply problems in that it is very difficult, if not impossible to predict the particular combinations and number of particular head covers that consumers will want. To illustrate this problem, most golfers will use a driver (no. 1) and at least two other woods which can be selected from different types of woods ranging from a two (2) wood through a seven (7) wood. Many golfers will use a three (3) wood whereas relatively few use a seven (7) wood, and so forth.

Also, if a golfer decides after initially selecting a set of head covers, to change the particular combination of woods that he or she uses, it may be difficult to find a matching head cover or covers for the new combination of woods. Further, with the head covers having the club identifying indicia provided on the above described hanging tags, if the tags become damaged or torn off, they can't be replaced without destroying the head cover.

The manufactures of head covers have long recognized this inventory and supply problem and some attempts have been made to provide detachable, and thus, replaceable indicial means. One particular prior art attempt as solving the indicia problem is disclosed in U.S. Pat. No. 3,295,236. This patent suggests that an indicia bearing disc, such as of plastic, be demountably carried in an annular pocket formed in the cover so as to circumscribe an opening formed in the outer covering material. The circular edge of the disc is carried in the annular pocket and a snap is provided on the cover and the disc to hold it in place. To the best of my knowledge, this particular prior art suggested solution did not achieve commercial acceptance, possibly due to manufacturing complexities. Another solution was suggested in U.S. Pat. No. 3,294,138. This head cover was made with a fabric tab extending from its closed upper end and an eyelet was provided in the tab. A plastic indicia bearing disc having an axially extending boss was attached to the tab by passing its boss through the eyelet. The eyelet and boss were configured to provide an interference fit to demountably interconnect the tab and the disc. Apparently this proposed solution also failed to achieve commercial acceptance possibly due to the necessity of using a relatively small disc with such a mounting technique, and such a small disc lacking the capability of providing highly visible club identifying indicia.

Therefore, a need exists for a new and improved golf club head cover which overcomes some of the problems and shortcommings of the prior art.

SUMMARY OF THE INVENTION

In accordance with the present invention, a new and improved golf club head cover with detachable identifying tag is disclosed.

The head cover is formed of a fabric-like material which is cut into a unique shape so that both the outer covering material and the liner are provided by a single piece of the material to reduce the multi-step manufacturing operations of the prior art by reducing the number of pieces which must be cut and otherwise handled and by reducing the number of seams which must be sewn. Also, the unique material configuration inherently produces the desired constriction of special configuration in the head cover without necessitating any additional materials or fabrication steps.

The detachable identification tag of the head cover of the present invention includes a planar tag which is molded or otherwise formed of a suitable synthetic resin, or plastic, material and displays the desired golf club identifying indicia on at least one and preferably both sides thereof. The tag is formed with an especially configured slot which is resiliently deformable for demoutably receiving a special connector means which is fixedly carried on a fabric loop that is stitched into a seam at the upper closed end of the head cover. The resiliently deformable slot defined by the identification tag and the connector means cooperatively interact to demountably fasten the tag to the head cover to overcome the prior art inventory and supply problems and to provide identification tag selection and replacement capabilities.

Accordingly, it is an object of the present invention to provide a new and improved golf club head cover.

Another object of the present invention is to provide a new and improved golf club head cover which is formed of a fabric-like material that is cut in a unique configuration so that the outer head covering material and the liner are formed of a single piece of material for simplified manufacturing thereof.

Another object of the present invention is to provide a new and improved golf club head cover of the above described character wherein the uniquely shaped fabric-like material inherently forms an especially configured constriction between the opposite ends of the head cover during fabrication thereof to further simplify the manufacturing.

Another object of the present invention is to provide a new and improved golf club head cover which is provided with a detachable indentifying tag to minimize inventory and supply problems and provide identification tag selection and replacement capabilities.

Another object of the present invention is to provide a new and improved golf club head cover of the above described character wherein the detachable identification tag is configured to define a resiliently deformable slot for demountably receiving a connector means that is fixedly carried on the closed upper end of the head cover.

The foregoing and other objects of the present invention as well as the invention itself, may be more fully understood from the following description when read in conjunction with the accompanying drawings.

BRIEF DESCRIPTION OF THE DRAWINGS

FIG. 1 is a plan view of a sheet of fabric-like material which has been cut into a unique configuration in preparation for fabrication of the golf club head cover of the present invention.

FIG. 2 is a side elevational view wherein the sheet of material shown in FIG. 1 has been folded longitudinally and sewn along a first seam.

FIG. 3 is a perspective view illustrating the golf club head cover as it appears subsequent to the folding and sewing of the first seam shown in FIG. 2 and showing the liner material at one end and of the outer covering material at the opposite end.

FIG. 7 is an enlarged sectional view taken along the line 7—7 of FIG. 6.

FIG. 8 is an exploded perspective view of the indentification tag and the connector means by which it is detachably mounted on the closed upper end of the head cover.

FIG. 9 is an enlarged fragmentary sectional view taken through an especially configured slot defined by the identification tag and showing the mounted relationship of the connector means therein.

DESCRIPTION OF THE PREFERRED EMBODIMENT

Figure 6:
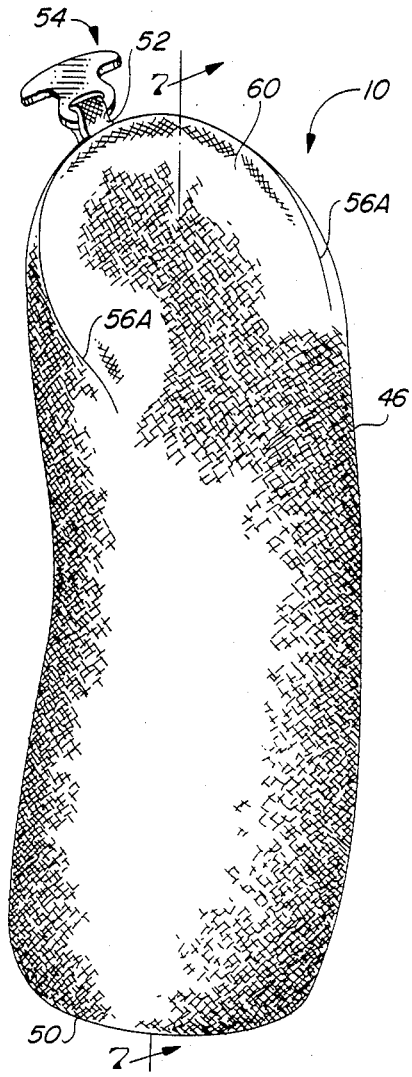
FIG. 6 is another perspective view of the head cover wherein fabrication thereof has been completed by a preferred second method wherein the head cover is turned into the right-side out position.

Referring more particularly to the drawings wherein FIGS. 1, 2, 3, 4, 5 and 6 show the various steps of the method of forming the golf club head cover of the present invention which is identified generally in the completed form by the reference numeral 10 in FIG. 6.

With particular reference to FIG. 1 wherein a sheet of fabric-like material 12 is shown in a flat plan view as having been cut, such as with a suitable die (not shown) in a unique configuration. As seen, the material 12 is of generally rectangular configuration having a longitudinal, or major, axis 14 which longitudinally bisects the material sheet 12 and a transverse, or minor, axis 16 which transversely bisects the material sheet. The longitudinal edges 18 and 19 are identical to each other and thus the following description of the longitudinal edge 18 will be understood to also apply the other longitudinal edge 19. The edge 18 is provided with opposite end land segments 20 and 21 and intermediate land segment 22 with inwardly curved edge segments 23 and 24 extending therebetween. The three land segments 20, 21 and 22 are of relatively short length and are normal with respect to the transverse axis 16 and the inwardly curved segments 23 and 24 are preferably of irregular configuration. As seen, the ends of the inwardly curved edge segments 23 and 24 which are proximate the intermediate land segment 22 are of regular curved shape and therefore provide a relatively pointed junction of the curves with the land segment 22. The other ends of the inwardly curved edge segments 23 and 24, e.g. where they meet the end land segments 20 and 21 are radiused so as to provide a reversed curve junction of S-shape which starts in about the center of the curved segments 23 and 24 and blends smoothly with the end land segments 20 and 21, for reasons which will hereinafter be described in detail.

The opposed end edges 26 and 27 of the sheet of fabric-like material 12 are identically configured to provide a protruding central flap portion 28 at the end edge 26 and an identical protruding central flap portion 29 on the opposite end edge 27. In that the end edges 26 and 27 are identical, the following description of the edge 26 will be understood to also apply to the opposite edge 27. The central flap 28 of the end edge 26 is defined by a land portion 30 on its extending end and is preferably formed with outwardly curved side edge portions 31 and 32. The innermost ends of the curved side edges 31 and 32 form junction points 33 and 34 with the inner ends of end edge segments 35 and 36 which extend from their respective junctions 33 and 34 to the ends of the longitudinal side edges 18 and 19 and are outwardly curved to match the curved configurations of the side edges 31 and 32 of the central flap 28 for reasons which will become apparent as this description progresses.

The fabric-like material sheet 12 which is cut into the above described configuration may, if desired, have a layer of cushioning material 38 stitched, tack stitched, or otherwise affixed thereto. The cushioning layer 38 may be of any suitably soft material such as sponge rubber, a foamed sheet of synthetic resin, or the like. A particular material which is ideally suited for this purpose is a low density light weight sheet of polyethylene foam.

In any event, the cushioning layer 38 is cut or otherwise formed to match on a slightly smaller scale the configuration of one of the transversely bisected ends of the fabric-like sheet of material 12. The cushioning layer 38 is placed in contiguous juxtaposed engagement with one of the transversely bisected halves of the material sheet 12, as shown and when so placed will leave an uncovered boarder, or lip, of the exposed fabric-like material around the cushioning layer.

The sheet of fabric-like material 12, either with or without the cushion layer 38 attached thereto, is folded along its longitudinal axis 14 in the manner indicated by the arrow 39 in FIG. 1, until the longitudinal edges 18 and 19 are in touching aligned relationship with each other. This folding operation is accomplished so that the lower longitudinally bisected half of the material sheet 12 as viewed in FIG. 1 will be behind the upper half as viewed in FIG. 2. The folding operation is accomplished in this particular fashion so that the cushion layer 38, and the unfinished side or backing, of the fabric-like sheet 12 will be facing out at this stage and the fabrication process The folded sheet material is then stitched as at 40 to provide a first sewn seam 42 along the aligned longitudinal edges of the sheet material 12. When this stitching of the first seam 42 is accomplished, the sheet material will then be in a more or less tubular configuration as seen best in FIG. 3, and the sewn seam 42 will be facing outwardly with respect thereto.

For reasons which will become apparent as this description progresses, the material on the right hand side of the minor axis 16, as viewed in FIGS. 1, 2 and 3, will form the liner material 44 of the completed head cover 10 and the material on the other side, e.g. left hand, of the transverse axis 16 will form the outer covering material 46 of the finished head cover 10.

Figure 4:
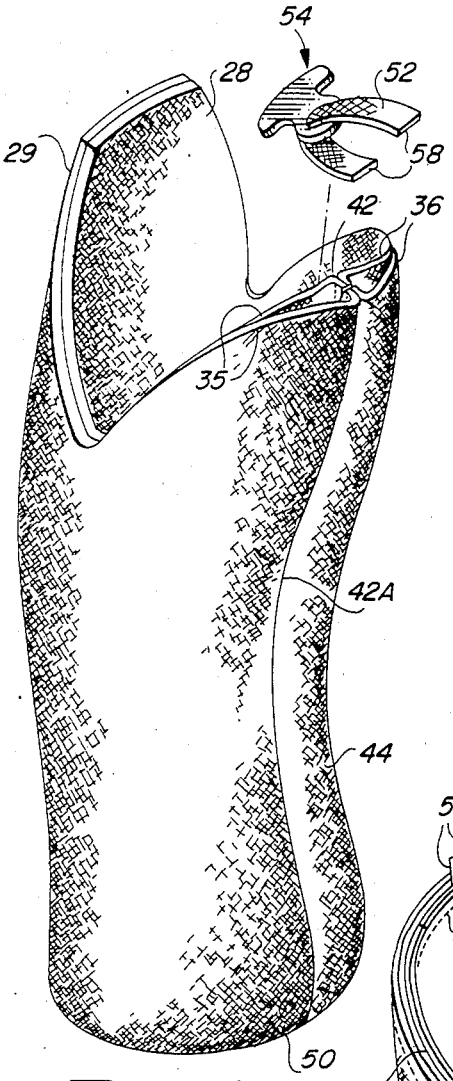
FIG. 4 is a perspective view of the head cover of the present invention in an inside-out position as it appears subsequent to the next fabrication step wherein the liner material has been folded back so as to overlay the outer covering material, and to show the placement of the fabric loop and connector means.

The next operation to be accomplished in fabricating the head cover 10 is to fold the liner material end portion 44 back on top of itself as indicated by the arrow 48 in FIG. 3 so that it overlays the outer covering material 46. This folding operation is accomplished to bring the opposed end edges 26 and 27 of the sheet material 12 into alignment with each other as shown in FIG. 4, and in doing so, two things will be accomplished. First, the material in the vicinity of the minor axis 16 will now circumscribe the lower open end 50 of the head cover and secondly, extending edges of the first seam 42, and the stitching 4 thereof will be disposed between the liner material 44 and the outer covering material 46 so as to form a blind seam as indicated at 42A on both the inside and outside of the head cover. When the head cover is manufactured with the above described cushion layer 38, it will be completely concealed between the liner material 44 and the outer covering material 46 as a result of this last described folding operation, as shown in FIG. 7.

Further as result of this last described folding operation, the extending flap portions 28 and 29 will be disposed in coextending contiguous engagement with each other and the end edges segments 35 and 36 of the aligned edges 26 and 27 will cooperate with the flaps 28 and 29 to circumscribe the upper end of the head cover, as shown in FIG. 4. When in this inside-out position, a fabric strip 52 having a connector means 54 positioned thereon, is folded back upon itself to form a loop, and is placed in the open upper end of the head cover in the manner indicated. The coextending flaps 28 and 29 are then folded toward end edge segments 35 and 36 of aligned edges 26 and 27 to form a second seam 56 which is then stitched as indicated at 57 in FIG. 5 and the aligned ends 58 of the looped fabric strip 52 are simultaneously stitched into the second seam 56 so as to be captively affixed therein.

When the second, and final, seam 56 is stitched as described above the head cover will be provided with a closed upper end 60 and the manufacturing of the head cover will be completed. However, it will be in an inside-out position and, as indicated by the arrow 61 in FIG. 5, will need to be turned right-side-out to provide the finished head cover 10 which is shown in FIG. 6. When turned right-side-out, the extending edges and the stitches 57 of the second seam 56 will be disposed inwardly of the head cover 10 and only the blind seam indicated at 56A will show on the exterior of the finished head cover 10. When in the finished right-side-out position, the looped fabric strap 52 and the connector means 54 will extend from the blind seam 56A at the closed upper end 60 of the head cover 10 as shown.

An alternate method may be used to complete the finished head cover rather than the above described turning of the head cover to the right-side-out position.

Figure 5:
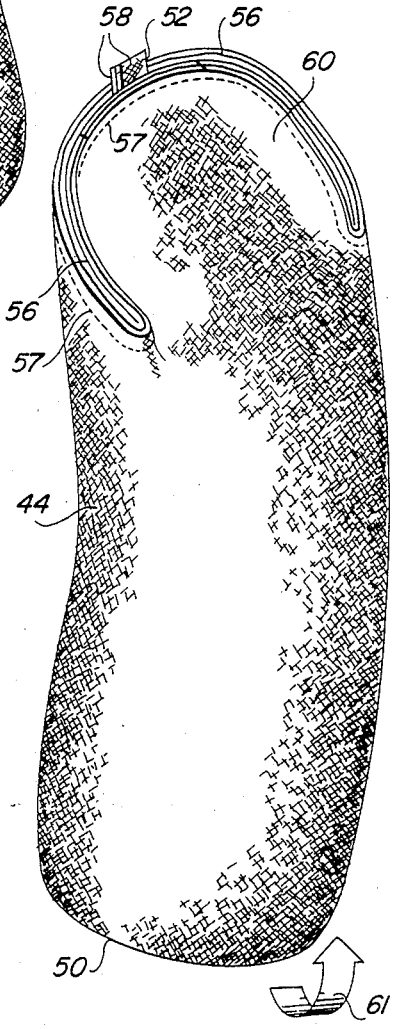
FIG. 5 is a perspective view of the head cover after its top end has been closed by sewing of a second seam.
Figure 5A:
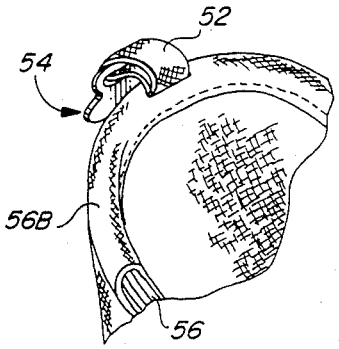
FIG. 5A is a fragmentary perspective view similar to FIG. 5 showing a first method of completing the fabrication of the head cover.

When the incompleted head cover is in the position shown in FIG. 4, the connector means 54 with the strip 52 thereon, are placed in the open upper end of the cover in a reversed position so that the connector means 54 will extend from the second seam 56 in the direction which is opposite to that shown in FIG. 5, as shown in FIG. 5A. When the second seam 56 is sewn, in the manner hereinbefore described, rather than turning the incomplete head cover to the right-side-out position shown in FIG. 6, the extending edges can be concealed with a strip of welting material 56B as is well known in the art and as indicated in FIG. 5A.

In either case, the second seam 56 as seen best at 56A in FIG. 6 will be of curved configuration as a result of the curved configurations of the side edges 31 and 32 and the end edge segments 35 and 36 of the sheet of fabric-like material hereinbefore described with particular reference to FIG. 1. Although those edges 31, 32, 35 and 36 could be straight, the curved configurations thereof are preferred to provide a better fit with the head of the golf club to be inserted into the head cover 10. The curved second seam 56A is formed in the manner shown so as to substantially match the trailing edge (not shown) of a wood-type golf club and is formed so as to conform with either a right hand or left hand golf club.

It has been found that by forming the relatively pointed junctions of the curves 23 and 24 with the intermediate land segment 22, as hereinbefore described with reference to FIG. 1, the constriction 62 which is inherently formed in the bore of the head cover 10, will be configured so as to act like an inclined plane proximate the lower open end 50 of the head cover 10. In this manner, a wedding action will take place when the head cover is being pulled onto the head 63 of a golf club, as indicated in FIG. 7, and this aids the passage of the head 63 through the constricted bore of the head cover 10. The S-shaped junction at the inner end of the constriction 62 will form a smooth and rapidly opening junction between the constriction and the full sized bore at the closed end of the head cover. By providing the smoothly and more rapidly opening junction, the velocity of the golf club head 63 will accelerate after leaving the constriction and this increased velocity will result in positive seating of golf club head 63 in the closed end of the cover 10, and the person placing the cover on the club head will feel the seating action.

It will be understood that the head cover 10 can be made from various fabric-like materials, with the term fabric being intended to include such materials as nylon, vinyl, synthetic materials and the like. A particular material which is ideally suited for this purpose is a short pile synthetic material having acrylic fibers with a polyester backing.

Reference is now made in particular to FIGS. 8 and 9 wherein the structural details of a preferred form of detachable identification tag 64 are shown. The detachable tag 64 includes a substantially planar body of any desired shape which is molded or otherwise formed, such as from a suitable synthetic resin, and has golf club identifying indicia 66 on at least one, and preferably both of the planar surfaces thereof. The tag 64 is formed to define an especially configured slot 68 for demountably receiving the hereinbefore mentioned connector means 54. The slot 68 is of elongated configuration with webs 70 and 72 extending toward each other from the opposite ends of the slot 68 and the webs are of reduced thickness in comparison to the thickness of the tag body 64, so that the webs 70 and 72 have the capability of being resiliently deflectable for reasons which will become apparent as this description progresses. The inwardly disposed ends of the webs 70 and 72 define the opposite sides of a generally rectangular central opening 74 formed through the tag body 64. The upper and lower longitudinal sides of the slot 68 are notched as at 75 and 76 to provide clearance for the fabric strip 52 during mounting of the tag on the connector means. In that the webs 70 and 72 are of reduced thickness, recessed cavities 78 and 80 are defined on opposite sides of each of the webs.

The connector means 54, which may also be molded or otherwise formed of a suitable synthetic resin, has a body of generally T-shaped configuration including an eyelet 82 and an integral cross bar 84 which is tangentially disposed relative to the eyelet to provide oppositely extending arms 85 and 86. The eyelet 82 defines an elongated opening 88 through which the fabric strap 52 is threadingly passed. The eyelet 82 is shown as being of generally oval configuration having a width dimension "A" which lies along its major axis which is parallel to the cross bar 84. It will be understood that the eyelet 82 may be of various other configurations such as circular (not shown) in which case the dimension "A" would be a diameter of the circle. In view of this, dimension "A" will hereinafter be referred to as the width dimension of the eyelet which will be understood to define the dimension of the eyelet 82 taken along a line parallel to the cross bar 84. The connector means 54 is provided with a neck 90 at the tangential junction of the eyelet 82 and the cross bar 84, and the neck 90 has a width dimension which is less than the width dimension "A" of the eyelet to provide recesses 92 and 94 on opposite sides of the neck.

To demountably attach the indentification tag 64 to the connector means 54, the connector means 54 is turned sideways and pushed through the central opening 74 of the slot 68 of the tag as indicated in dashed lines in FIG. 8. After being passed through the central opening 74 of the slot 68 in this manner, the connector means 54 is turned through about 90° of rotation to bring the cross bar 84 into parallel relationship with the slot 68 and to locate the eyelet 82 proximate the central opening 74 of the slot. The width dimension "A" of the eyelet 82 is greater than the longitudinal dimension of the central opening 74 of the slot and the width dimension of the neck 90 is approximately equal thereto. Therefore, after the connector means 54 has been rotated as described above, it will need to be forcefully pushed into the installed position. The larger width dimension "A" of the eyelet 82 will deflect the webs 70 and 72 as it passes through the temporarily enlarged central opening 74 of the slot 68, and the deflected webs will resiliently snap into the recessed notches 92 and 94 on the opposite sides of the neck 90 of the connector means 54.

By being connected to the head cover 10 in the above described manner, the particular identification tag 64 to be installed may be selected from a plurality of such tags having various golf club indicia thereon and, the selection and installation may be accomplished at the time of purchase thus simplifying both the manufactures and supplying of the product. If for any reason, it should become necessary or desirable to replace an installed tag 64 with a different one, it can be easily accomplished by simply reversing the above described installation technique.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What we claim is:

1. A method for making a golf club head cover including the steps of:

(a) cutting a sheet of fabric-like material into a substantially rectangular shape having a liner portion on one side of a substantially bisecting transvese axis and an outer cover portion on the opposite side, said sheet having identical longitudinal edges each defining inwardly curved edge segments on opposite sides of the transverse axis and having substantially identical end edges each defining a flap portion protruding centrally from between an oppositely extending pair of end edge segments;

(b) folding said sheet longitudinally to form a substantially tubular sheet with its longituding edges in contiguous alignment;

(c) sewing the aligned longitudinal edges of said tubular sheet subsequent to step b;

(d) folding said tubular sheet about its transverse axis by moving said liner portion into an overlaying coextending position on said cover portion to form an incomplete head cover having open ends one of which is defined by substantially aligned flap portions and substantially aligned end edge segments of the identical end edges and said sheet;

(e) moving the aligned flap portions subsequent to step d into contiguous alignment with the aligned end edge segments of said incomplete head cover; and (f) sewing the moved flap portion to the end edge segments subsequent to step e to form an end closing seam at the one open end of said head cover.

2. The method of claim 1 including the further step of turning said head cover into a right-side-out position subsequent to step f.

3. The method of claim 1 including the further step of sewing a strip of welting material on the end closing seam subsequent to step f to conceal that end closing seam.

4. The method of claim 1 wherein each of the inwardly curved edge segments of each of the longitudinal edge of said sheet have a first end which is spaced from the transverse axis of said sheet and a second end which is spaced from the extending end of its respective one of the longitudinal edges to form a constricuted bore in said head cover.

5. The method of claim 1 wherein each of the longitudinal edges of said sheet has the oppositely disposed inwardly curved edge segments thereof spaced apart by a central land edge segment means that extends therebetween and is normal with respect to the transvese axis of said sheet, said central land edge segment means forming a relatively pointed junction with each of the inwardly curved edge segments.

6. The method of claim 1 wherein each of the longitudinal edges of said sheet have an end land segment formed at each of its opposite ends, each of said end land segments being normal with respect to the transverse axis of said sheet and each forming a junction with one of the inwardly curved edge segments of its respective one of said longitudinal edges.

7. The method of claim 6 wherein the junction of each of the end land segments and its respective one of the inwardly curved edge segments is of substantially S-shape configuration.

8. The method of claim 1 wherein the flap portion of each of the identical end edges of said sheet is defined by a land portion on its protruding end and a pair of spaced apart side edges which extend from the opposite ends of said land portion toward the transverse axis of said sheet, each of said spaced apart side edges having an extending end which forms a junction with a different one of the oppositely extending pair of end edge segments of its respective one of said identical end edges of said sheet.

9. The method of claim 8 wherein the spaced apart side edges of the flap portion of each of the identical end edges of said sheet divergingly extend from the land portion thereof.

10. The method of claim 8 wherein the spaced apart side edges of the flap portion of each of the identical end edges of said sheet divergingly extend from the land portion thereof and are curved outwardly along their lengths.

11. The method of claim 10 wherein the oppositely extending pair of end edge segments of each of the identical end edges of said sheet are curved along their lengths to match the outwardly curved configuration of the spaced apart side edges of the flap portion from which they oppositely extend.

12. The method of claim 1 including the further steps of:

(I) cutting a sheet of cushioning material into a configuration which matches but is smaller than the configuration of the liner portion of said sheet of fabric-like material; and (II) placing said sheet of cushioning material in contiguous engagement with the liner portion of said sheet of fabric-like material prior to step d.

13. The method of claim 12 wherein step II is accomplished so as to locate the sheet of cushioning material in an interposed position between the cover portion and liner portion of said incomplete head cover upon completion of step d.

14. The method of claim 1 including the further steps of:

(I) cutting a sheet of cushioning material into a configuration which matches but is slightly smaller than the configuration of the liner portion of said sheet of fabric-like material;

(II) placing said sheet of cushioning material in contiguous engagement with the liner portion of said sheet of fabric-like material prior to step b; and (III) attaching said sheet of cushioning material in place on the liner portion of said sheet of fabric-like material prior to step b.

15. The method of claim 14 wherein step II is accomplished so that said sheet of cushioning material will be disposed on the outside of the tubular sheet formed by step b.

16. The method of claim 1 including the further steps of:

(I) cutting a fabric-like material to form a strap;

(II) threading said strap through a slot defined by a connector means;

(III) folding said strap subsequent to step II into a loop having its opposite ends in aligned engagement with each other;

(IV) placing the aligned ends of said strap between the aligned flap portions and the aligned end edge segments prior to step f.

17. The method of claim 16 including the further step of attaching a golf club identification tag to said connector means, said connector means and said identification tag being configured with cooperating elements of a demountable interconnection thereon.

18. A golf club head cover made in accordance with the method of claim 1.

19. A golf club head cover as claimed in claim 18 and further comprising:

(a) a loop shaped strap extending from the closed end of said head cover;

(b) connector means carried by said loop-shaped strap;

(c) a tag of planar configuration having golf club identification indicia on at least one surface thereof and defining a slot means proximate one edge thereof, said tag having the slot means defined thereby in demountable engagement with said connector means.

20. A golf club head cover as claimed in claim 19 wherein said tag is configured to define the slot means thereof as being of elongated configuration with a pair of reduced thickness resiliently deflectable webs each disposed in a different end of the slot means of said tag and extending toward each other to define the width dimension of a central opening formed therebetween.

21. A golf club head cover as claimed in claim 20 wherein said connector means includes a body which comprises:

(a) an eyelet defining an opening through which said loop shaped strap is threadingly disposed;

(b) a crossbar tangential with respect to said eyelet and having a length dimension which is approximately equal to the length of the slot means of said tag;

(c) said eyelet having a width dimension which is parallel to said crossbar and is slightly larger than the width dimension of the central opening of the slot means of said tag; and (d) a neck portion integral with said eyelet and said crossbar and disposed at the tangential junction thereof, said neck portion having a width dimension which is approximately equal to the width of the central opening of the slot means of said tag.

22. A golf club head cover with detachable identification tag comprising:

(a) a golf club head cover means having a closed end;

(b) a tag of planar configuration having golf club identification indicia on at least one of the planar surfaces thereof and defining a slot means proximate one edge therefore;

(c) a loop shaped strap fixedly extending from the closed end of said head cover means;

(d) connector means carried on said loop shaped strap and including means in demountable frictional engagement with the slot means defined by said tag to detachably connect said tag to said head cover.

23. A golf club head cover as claimed in claim 22 wherein said tag is configured to provide the slot means thereof with a central opening the opposite ends of which are defined by a spaced apart pair of resiliently deflectable webs.

24. A golf club head cover as claimed in claim 23 wherein said connector means includes a body having a reduced width neck portion between its opposed ends which is disposed in the slot means of said tag so as to extend between the resiliently deflectable webs which define the opposite ends of the central opening thereof.

25. A golf club head cover as claimed in claim 24 wherein the body of said connector means is of substantially planar configuration having an eyelet on one end thereof which has a width dimension slightly larger than the distance between the opposite ends of the central opening defined by the resiliently deflectable webs so that when said eyelet end of said body is pushed into the slot emans of said tag it will deflect the resiliently deflectable web to temporarily enlarge the central opening of the slot means of said tag to allow said eyelet end of said body to pass therethrough.

26. A golf club head cover as claimed in claim 22 wherein said tag is configured to define the slot means thereof as being of elongated configuration with a pair of reduced thickness resiliently deflectable webs each disposed in a different end of the slot means of said tag and extending toward each other to define the width dimension of a central opening formed therebetween.

27. A golf club head cover as claimed in claim 26 wherein said connector means includes a body which comprises:

(a) an eyelet defining an opening through which said loop shaped strap is threadingly disposed;

(b) a crossbar tangential with respect to said eyelet and having a length dimension which is approximately equal to the length of the slot means of said tag;

(c) said eyelet having a width dimension which is parallel to said crossbar and is slightly greater than the width dimension of the central opening of the slot means of said tag; and (d) a neck portion integral with said eyelet and said crossbar and disposed at the tangential junction thereof, said neck portion having a width dimension which is approximately equal to the width of the central opening of the slot means of said tag.

* * * * *